United States Patent [19]

Baumgarte et al.

[11] 4,240,792

[45] Dec. 23, 1980

[54] AFTER-TREATMENT OF DYED OR PRINTED SYNTHETIC FIBERS

[75] Inventors: Ulrich Baumgarte, Limburgerhof; Sigismund Heimann, Ludwigshafen; Michele Vescia, Limburgerhof; Johannes Winkler, Birkenau, all of Fed. Rep. of Germany

[73] Assignee: BASF Aktiengesellschaft, Fed. Rep. of Germany

[21] Appl. No.: 947,587

[22] Filed: Oct. 2, 1978

[30] Foreign Application Priority Data

Oct. 4, 1977 [DE] Fed. Rep. of Germany ..... 2744607

[51] Int. Cl.[3] ..... D06P 5/02

[52] U.S. Cl. ..... 8/607; 8/137

[58] Field of Search ..... 8/73, 74, 137

[56] References Cited

U.S. PATENT DOCUMENTS

| | | | |
|---|---|---|---|
| 3,995,996 | 12/1976 | Pantke | 8/74 |
| 4,029,469 | 6/1977 | Boyd | 8/73 |

*Primary Examiner*—Paul R. Michl

*Attorney, Agent, or Firm*—Keil & Witherspoon

[57] ABSTRACT

Dyed or printed synthetic fibers or materials consisting of synthetic fibers or of a mixture of synthetic fibers with other fibers are aftertreated with aqueous solutions which contain from 0.2 to 20 g/l of a mixture of one or more surfactants and a reductonate. The pH of the liquor is brought to above 8 and the aftertreatment is carried out at from 40° to 100° C.

8 Claims, No Drawings

AFTER-TREATMENT OF DYED OR PRINTED SYNTHETIC FIBERS

The present invention relates to a process in which dyed or printed synthetic fibers, which may for example be in the form of materials which consist of synthetic fibers or of mixture of synthetic fibers with other fibers, are aftertreated at a pH above 8 with an aqueous solution of an assistant mixture comprising a reducing agent and a surfactant.

Materials consisting of synthetic fibers, especially of polyester fibers, which have been dyed or printed with disperse dyes must be subjected to a reductive after-treatment to remove the excess dye which has not been fixed. This is particularly necessary with materials which have been dyed in dark hues. The unfixed dye will otherwise detract from the fastness of the dyeing, eg. the rubfastness, wetfastness and lightfastness. It is known to after-treat dyed textiles of synthetic fibers with an alkaline aqueous solution which contains sodium dithionite as a reducing agent together with surfactants. A disadvantage of this process is the instability of alkaline sodium dithionite solutions. On standing exposed to air, these solutions lose their effectiveness as reducing agents within a few hours. Furthermore, the conventional reducing agents pollute the effluent by introducing sulfate and sulfite ions.

The present invention seeks to provide a process of the above type using a reducing agent which is stable in alkaline solution in the presence of atmospheric oxygen, but is biologically degradable.

According to the invention there is provided a process of the above type, wherein a reductonate is used as the reducing agent and the after-treatment is carried out at from 40° C. to 100° C. Monohydroxyacetone is a particularly preferred reducing agent.

Synthetic fibers which can be after-treated in accordance with the invention include, in particular, polyester fibers, which may be after-treated on their own or as mixtures with other fibers, the polyester fibers having been dyed or printed with a disperse dye or dyes. The process of the invention is also applicable to triacetate fibers and triacetate fiber mixtures which have been dyed or printed with a disperse dye or dyes, and to nylon fibers which have been dyed or printed in dark hues with a metal complex dye or dyes. The form of the fibers is immaterial as regards the process of the invention; for example, the fibers may be in the form of staple, yarn or fabric.

Reductonates are compounds which in alkaline solution are in the form of the enolate and in this form act as reducing agents. At an acid pH, these compounds do not act as reducing agents; cf. H. Ilg and G. Meyer MELLIAND, 43, 391 (1962). Examples of known reductonates are monohydroxyacetone, dihydroxyacetone, glycolaldehyde, dihydroxybutanone and various saccharide degradation products, monohydroxyacetone being of particular importance for the process of the invention.

Preferably, the after-treatment of dyed or printed synthetic fibers is carried out, according to the invention, with an assistant mixture which consists of from 20 to 80 parts by weight of a reductonate or of a mixture of reductonates and from 80 to 20 parts by weight of a surfactant or of a mixture of surfactants, eg. a detergent, a dispersant and/or a lubricant. The surfactants may be employed undiluted or as an aqueous solution or paste.

The mixtures should be neutral or slightly acid and are rendered alkaline for use by addition of a basic compound.

Nonionic and anionic surfactants may be used. Suitable nonionic surfactants which, like the anionic surfactants, are used as detergents, are oxyalkylation products which are obtained, for example, by adduct formation of eythylene oxide, propylene oxide or mixtures of these with fatty alcohols, alkyl-substituted phenols, fatty acids, carboxylic acid esters, carboxylic acid amides or alkylamines. For example, if ethylene oxide is used as the alkylene oxide, from 5 to 100 moles of ethylene oxide are as a rule reacted per mole of the above compounds. Suitable compounds for oxyalkylation are, for example, saturated and unsaturated $C_{12}$- to $C_{24}$-alcohols, $C_4$- to $C_{18}$-alkylphenols, $C_{12}$- to $C_{24}$-carboxylic acids, their esters and amides, and $C_{12}$- to $C_{24}$-alkylamines. Compounds of this type are commercially available.

Anionic surfactants are compounds which contain a hydrophobic radical and an anionic hydrophilic radical. Examples of hydrophilic radicals are $—SO_3H$, —COOH, $—PO(OH)_3$ and radicals corresponding to their water-soluble salts.

Examples of suitable hydrophobic radicals of the anionic surfactants are the following: $C_{12}$- to $C_{24}$-alkyl, $C_4$- to $C_{18}$-alkyl-substituted aryl, $C_{12}$- to $C_{24}$-carboxylic acid amide, $C_{12}$- to $C_{24}$-carboxylic acid ester, and $C_{12}$- to $C_{24}$-alkyl-substituted benzimidazole radicals and the adducts of the said radicals with ethylene oxide and/or propylene oxide. Surfactants containing radicals of these groups are also commercial products. They are used, together with a reductone, with or without admixture of nonionic surfactants, for the after-treatment, according to the invention, of dyed synthetic fibers.

Dispersants may also be used as the surfactants. Examples of suitable dispersants are condensation products of $\beta$-naphthalenesulfonic acid and formaldehyde, and ligninsulfonates. Lubricants may also be used as surfactants. Suitable lubricants, and the above dispersants, are commercially available, cf. Chwala/Anger, Handbuch der Textilhilfsmittel, Verlag Chemie, Weinheim-New York, 1977, pages 685–696 and 508 et seq.

The detergent(s), dispersant(s) and/or lubricant(s) are used together with one or more reductonates to form the assistant mixtures. Usually, mixtures which consist of from 80 to 20 parts by weight of one or more reductonates and from 20 to 80 parts by weight of one or more surfactants, eg. a dispersant, detergent and/or lubricant, are employed. In the process of the invention, an amount by weight of the above mixture which is at least equal to that of the unfixed dye which has remained in the dyebath or on the fibers is employed for best results. The amount of the assistant mixture to be employed can therefore vary within wide limits. In general, the said mixture is employed at a concentration of from 0.2 to 20, preferably from 0.5 to 10, g/l. The after-treatment of the dyed or printed synthetic fibers may be carried out continuously or batchwise. It is effected in an aqueous bath at a pH greater than 8, eg. up to 13, preferably at a pH of from 9 to 13, and at from 40° C. to 100° C., preferably from 60° C. to 80° C. The pH of the treatment liquor may be brought to the required value by, for example, sodium hydroxide solution, sodium carbonate, ammonia or trisodium phosphate. The duration of the treatment depends on the temperature of the treatment liquor and on the alkali concentration, but is in general from 1 to 30 minutes.

There are various possible ways of carrying out the process of the invention in practice. For example, in the case of a batchwise dyeing process, the required amount of assistant mixture and alkali can be added to th dyebath after dyeing, and the fibrous material can be left therein at a temperature within the stated range. Alternatively, the cleansing after-treatment of the dyed or printed synthetic fibers may be carried out in a separate bath. This latter alternative is of interest particularly in continuous dyeing processes. In these, the dyed textile can be passed continuously through an alkaline aqueous solution of the assistant mixture comprising the reductonate and the surfactant. As already mentioned, the process of the invention is used especially for the cleansing after-treatment of polyester fibers dyed with disperse dyes. In this process, the assistant mixture comprising the reductonate and surfactant may already be present in the liquor during dyeing. After dyeing, alkali is added to the dyeing liquour to bring the pH to above 8, and the dyed material can then be after-treated in this bath at from 40° C. to 100° C. This embodiment of the process is similarly applicable to other types of fibers, eg. triacetate fibers and nylon fibers dyed with metal complex dyes.

The Examples which follow illustrate the process of the invention. Parts and percentages are by weight.

EXAMPLE 1

Texturized polyester yarn is dyed, using a liquor ratio of 10:1 for 60 minutes at 130° C. in an aqueous bath containing 5%, based on yarn of the yellow disperse dye Color Index No. 47,023, and 1%, based on yarn of a commercial dispersant (sodium salt of a naphthalenesulfonic acid/formaldehyde condensation product), together with acetic acid to bring the pH to 5. The bath is then cooled to 70° C. and, per liter, 2 g of a mixture of 50 parts of monohydroxyacetone and 50 parts of a fatty alcohol polyglycol ether (prepared by adduct formation of 20 moles of ethylene oxide with 1 mole of a $C_{12}$- to $C_{18}$-fatty alcohol mixture) and 2 ml of sodium hydroxide solution of 38° Be strength (440 g of NaOH per liter) are added, the pH being 12. The polyester fiber yarn is treated with this solution for from 10 to 20 minutes at 70° C. and is then rinsed with warm water. A deep yellow rubfast and washfast dyeing is obtained.

The same results are obtained if instead of the fatty alcohol polyglycol either the same amount of a reaction product of 1 mole of nonylphenol with 10 moles of ethylene oxide is used.

EXAMPLE 2

A knitted fabric of texturized polyester yarn is dyed, using a liquor ratio of 8:1 (based on yarn), for 60 minutes at 125° C. in an aqueous bath containing 4% based on yarn, of the red disperse dye Color Index No. 60,756 and 1% based on yarn, of the dispersant described in Example 1, together with acetic acid to bring the pH to 5. The bath containing the goods is then cooled to 70° C. Per liter of liquor, 4 g of a mixture of 30 parts of monohydroxyacetone and 70 parts of a neutral 40% strength aqueous solution of the diethanolamine salt of dodecylbenzenesulfonic acid, and 4 ml of sodium hydroxide solution of 38° Be strength are then added, the pH being 12. The dyed material is after-treated in this bath at 70° C. and then rinsed with soft water at 40° C. A deep red rubfast and washfast dyeing is obtained.

The same results are obtained if instead of the above mixture of the diethanolamine salt of dodecylbenzenesulfonic acid and monohydroxyacetone 3 g/l of a mixture of 50 parts of monohydroxyacetone and 50 parts of a neutral 30% strength aqueous solution of the sodium salt of a commercial naphthalenesulfonic acid/formaldehyde condensation product are employed.

EXAMPLE 3

At 67:33 polyester/cotton union fabric is padded at room temperature with an aqueous liquor which contains 100 g/l of an orange disperse dye Color Index No. 26,080 and 1 g/l of a water-soluble commercial polyacrylate thickener, and is dried at 100° C. The dye is then fixed to the polyester fiber component by treatment with hot air at 210° C. for 1 minute. The fabric is then washed continuously in an aqueous bath which contains 5 g/l of a mixture of 50 parts of monohydroxyacetone and 50 parts of an oleic acid polyglycol ether (an adduct of from 12 to 15 moles of ethylene oxide per mole of oleic acid) and 6 m/l of sodium hydroxide solution of 38° Be strength, at 90° C., the pH being 12.7. Thereafter it is rinsed with warm water and dried, and the cotton component is dyed with suitable reactive dyes.

EXAMPLE 4

Cheeses of polyester staple yarns are dyed, using a liquor ratio of 20:1, for 60 minutes at 130° C. in an aqueous bath which contains 5%, based on the yarn, of the blue disperse dye Color Index No. 63,285 and 3 g/l of a mixture of 50 parts of monohydroxyacetone and 50 parts of the stearic acid ester of a $C_{14}$- to $C_{18}$-fatty alcohol mixture which has been oxyethylated with 12 moles of ethylene oxide. The liquor containing the dyed material is then cooled to 70° C. and 2 ml/l of sodium hydroxide solution of 38° Be strength are added, the pH being 12. The yarn is left in this bath at 70° C. for from about 15 to 20 minutes and is then rinsed with soft water. The dyeing is rubfast and washfast. The yarn is smooth and unwinds easily from the cheese.

EXAMPLE 5

A triacetate fabric is printed with a print paste comprising 40 g of a red disperse dye Color Index No. 11,210, 500 g of a stock thickener (10% strength aqueous locust bean ether gum solution), 10 g of sodium m-nitrobenzenesulfonate and 450 g of water, and is dried. The print is then fixed either by steaming (15 minutes under 2.0 bar steam pressure) or by means of hot air (1 minute at 200° C.). Thereafter, the fabric is washed by leaving it for 10 minutes at 60° C. in a bath which contains 3 g/l of a mixture of 50 parts of monohydroxyacetone and 50 parts of oleylamine oxyethylated with 14 moles of ethylene oxide, and 3 ml/l of sodium hydroxide solution of 38° Be strength, the pH being 12.5. The fabric is then rinsed with warm water. The print is rubfast and washfast, and the ground remains white.

EXAMPLE 6

A yarn of a 50:50 mixture of polyester fibers and rayon staple is dyed, using a liquor ratio of 10:1, in an aqueous bath, with 4%, based on the polyester fibers, of the red disperse dye Color Index No. 11,080, following the method described in Example 1. After cooling the dyeing liquor to 90° C. and draining it off, the yarn is treated in a fresh bath, at 80° C., with an aqueous solution which contains 3 g/l of a mixture consisting of 33 parts of dihydroxyacetone, 33 parts of a oleic acid polyglycol ester (obtained by reacting 1 mole of oleic acid with 7 moles of ethylene oxide) and 33 parts of water, and 2 ml/l of sodium hydroxide solution of 38° Be strength, the pH being 12. After about 15 minutes' treatment, the yarn is rinsed with fresh water. The rayon staple component is then dyed with reactive dyes.

EXAMPLE 7

Tights made from nyon-6 fibers are dyed for 90 minutes at the boil, using a liquor ratio of 15:1, in an aqueous liquor which contains 6%, based on the fibers, of a black 1:1 metal complex dye Color Index No. 15,711, 0.5 g/l of a $C_{16}/C_{18}$-fatty alcohol polyglycol ether (obtained by reacting a $C_{16}/C_{18}$-fatty alcohol mixture with 20 moles of ethylene oxide) and 6 ml/l of 30% strength acetic acid. After the dyebath has cooled to 50° C., it is drained off. The tights are then treated in a fresh bath with an aqueous solution, at 70° C., which contains 2% of a mixture consisting of 50 parts of monohydroxyacetone, 20 parts of a reaction product of 1 mole of stearic acid with 1 mole of triethanolamine and 2 moles of ethylene oxide, and 30 parts of water, and 2 g/l of trisodium phosphate, the pH being 11. The material is then rinsed with warm water. The tights have a soft hand and the dyeing is rubfast and washfast.

We claim:

1. A process for the after-treatment of dyed or printed synthetic fibers, or of materials which consist of synthetic fibers or contain a mixture of synthetic fibers and other fibers, using an aqueous solution which contains from 0.2 to 20 g/l of a mixture of (a) from 80 to 20 parts by weight of a reductonate selected from the group consisting of monohydroxyacetone, dihydroxyacetone, dihydroxybutanone and glycolaldehyde, and (6) from 20 to 80 parts by weight of one or more nonionic and/or anionic surfactants, the after-treatment being carried out at from 40° to 100° C. and at a pH about 8.

2. A process as set forth in claim 1, wherein monohydroxyacetone is employed as the reductonate.

3. A process as set forth in claim 1, wherein a nonionic and/or anionic detergent is used as the surfactant.

4. A process as set forth in claim 1, wherein a dispersant is used as the surfactant.

5. A process as set forth in claim 1, wherein a lubricant is used as the surfactant.

6. A process as set forth in claim 1, wherein from 0.5 to 10 g/l of a mixture of (a) from 80 to 20 parts by weight of monohydroxyacetone and (b) from 20 to 80 parts by weight of a nonionic and/or anionic surfactant is used.

7. A process as set forth in claim 1, wherein a nonionic detergent is used as the surfacant.

8. A process as set forth in claim 1, wherein an anionic detergent is used as the surfactant.

* * * * *

UNITED STATES PATENT AND TRADEMARK OFFICE

CERTIFICATE OF CORRECTION

PATENT NO. : 4,240,792

DATED : December 23, 1980

INVENTOR(S) : Ulrich Baumgarte, Sigismund Heimann, Michele Vescia, and Johannes Winkler It is certified that error appears in the above—identified patent and that said Letters Patent is hereby corrected as shown below:

On claim 1, column 6, line 10, "about" should read --above--.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*